US011782357B2

(12) United States Patent
Shimizu et al.

(10) Patent No.: US 11,782,357 B2
(45) Date of Patent: Oct. 10, 2023

(54) DEVELOPING DEVICE AND IMAGE FORMING APPARATUS INCLUDING THE SAME

(71) Applicant: KYOCERA Document Solutions Inc., Osaka (JP)

(72) Inventors: Tamotsu Shimizu, Osaka (JP); Yuji Toyota, Osaka (JP); Yasuhiro Tauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/859,307

(22) Filed: Jul. 7, 2022

(65) Prior Publication Data

US 2023/0034149 A1 Feb. 2, 2023

(30) Foreign Application Priority Data

Jul. 14, 2021 (JP) ..... 2021-116255

(51) Int. Cl.
*G03G 15/08* (2006.01)
*G03G 15/09* (2006.01)

(52) U.S. Cl.
CPC ..... *G03G 15/0812* (2013.01); *G03G 15/09* (2013.01)

(58) Field of Classification Search
CPC ..... G03G 15/0812; G03G 15/09
See application file for complete search history.

(56) References Cited

U.S. PATENT DOCUMENTS

| | | | | |
|---|---|---|---|---|
| 5,434,351 | A | 7/1995 | Iwai et al. | 118/658 |
| 5,991,586 | A | 11/1999 | Nagao | 399/274 |
| 2018/0203376 | A1* | 7/2018 | Shimizu | G03G 15/0928 |

FOREIGN PATENT DOCUMENTS

| | | | |
|---|---|---|---|
| JP | 5-94858 | U | 12/1993 |
| JP | 10-133481 | A | 5/1998 |

* cited by examiner

*Primary Examiner* — Walter L Lindsay, Jr.
*Assistant Examiner* — Milton Gonzalez
(74) *Attorney, Agent, or Firm* — Stein IP, LLC

(57) ABSTRACT

A developing device includes a developing container storing a two-component developer, a developer carrying member, and a regulation member. The developer carrying member includes a developing sleeve, and a magnet having a regulation pole opposite the regulation member and a main pole opposite the image carrying member. The regulation member is arranged downstream of the position at which the vertical magnetic force of the regulation pole is 0 [mT] but upstream of a position at which the vertical and horizontal magnetic forces of the regulation pole are equal. Let the horizontal magnetic force gradient at the position at which the horizontal magnetic force of the main pole is 0 [mT] be A and the horizontal magnetic force gradient at the upstream-side surface of the regulation member along the rotation direction of the developing sleeve be B, then $|A|>2.45$ and $|B|<1.30$.

4 Claims, 3 Drawing Sheets

DEVELOPING DEVICE AND IMAGE FORMING APPARATUS INCLUDING THE SAME

INCORPORATION BY REFERENCE

This application is based upon and claims the benefit of priority from the corresponding Japanese Patent Application No. 2021-116255 (filed on Jul. 14, 2021), the entire contents of which are incorporated herein by reference.

BACKGROUND

The present disclosure relates to a developing device that is mounted in an image forming apparatus including an image carrying member, such as a copy machine, a printer, a facsimile, or a multi-functional peripheral having functions thereof. The present disclosure relates particularly to a developing device that employs a two-component development method using a two-component developer including a toner and a carrier and an image forming apparatus including the same.

In an image forming apparatus, an electrostatic latent image formed on an image carrying member such as a photosensitive drum is developed by a developing device into a visible toner image. One type of such a developing device employs the two-component development method using a two-component developer including a magnetic carrier and a toner.

In a two-component development method, carrier with the polarity opposite to toner may be developed in the white background on a photosensitive member. This is called carrier development, and is an important problem to be solved. Carrier development is known to worsen when carrier has a large amount of electric charge, when a high electric field is applied to a development region, when carrier has a low magnetic force, when carrier has a low electrical resistance, and when a main pole has a low vertical magnetic force. These factors affect various aspects of image quality such as image density, fogging, and development ghost, and thus a design has to be worked out with consideration given to the overall balance.

SUMMARY

According to one aspect of the present disclosure, a developing device includes a developing container, a developer carrying member, and a regulation member, and develops an electrostatic latent image formed on the surface of an image carrying member into a toner image. The developing container stores a two-component developer containing a magnetic carrier and a toner. The developer carrying member is rotatably supported on the developing container and carries the developer on its outer circumferential surface. The regulation member is arranged to be opposed at a prescribed distance to the developer carrying member. The developer carrying member includes a developing sleeve and a magnet. The developing sleeve is rotatable, carries the developer, and has a surface on which a magnetic brush is formed. The magnet is unrotatably secured in the developing sleeve and has a plurality of magnetic poles arranged at a prescribed distance from each other in the circumferential direction, which include a regulation pole that is arranged in a regulation portion opposed to the regulation member and a main pole that is arranged in a development region opposed to the image carrying member on the downstream side of the regulation pole with respect to the rotation direction of the developing sleeve. The regulation member is arranged, with respect to the rotation direction of the developing sleeve, on the downstream side of the position at which the vertical magnetic force of the regulation pole is 0 [mT] but on the upstream side of the position at which the vertical magnetic force and the horizontal magnetic force of the regulation pole are equal. When the horizontal magnetic force gradient at the position at which the horizontal magnetic force of the main pole is 0 [mT] is represented by A and the horizontal magnetic force gradient at the upstream-side surface of the regulation member with respect to the rotation direction of the developing sleeve is represented by B, then $|A|>2.45$ and $|B|<1.30$ are fulfilled.

DETAILED DESCRIPTION

Figure 1:
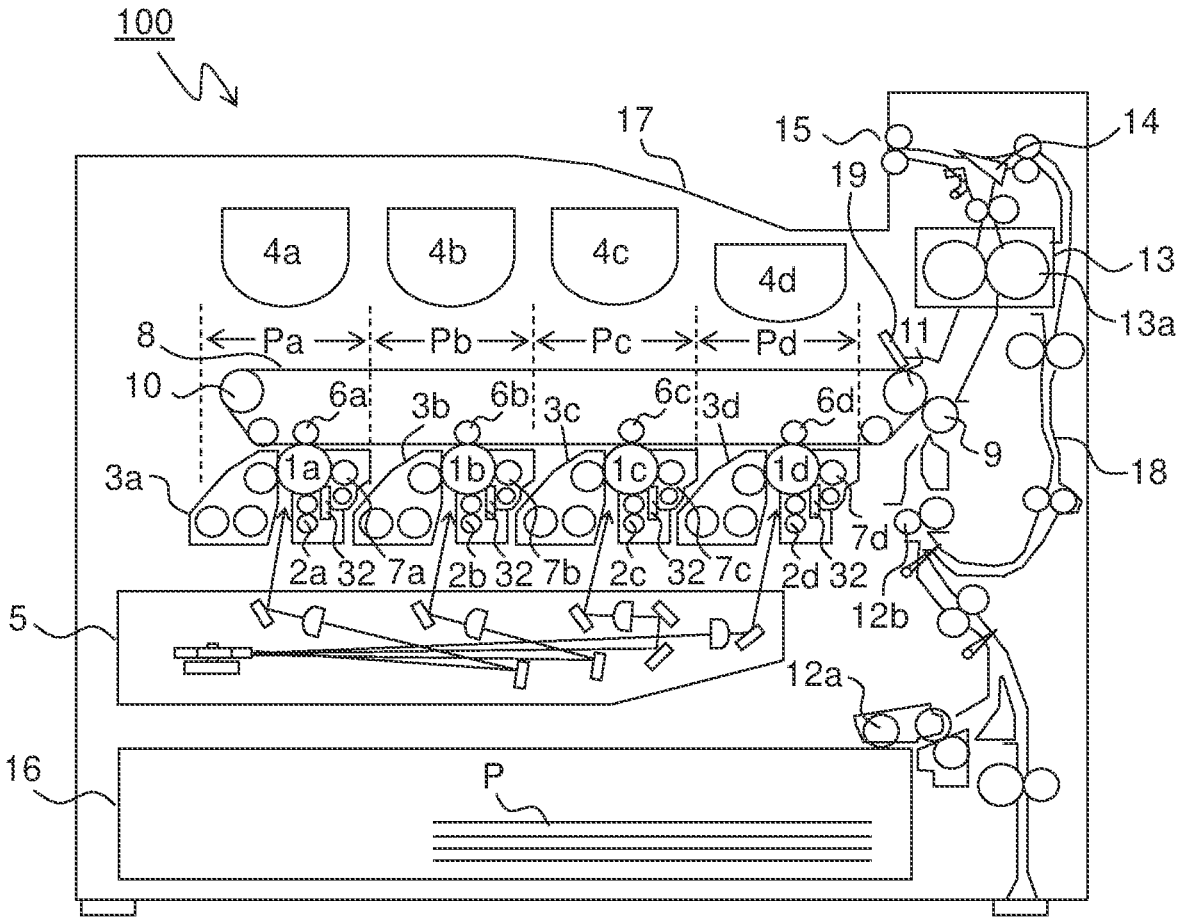
FIG. 1 is a side sectional view showing an internal configuration of an image forming apparatus including a developing device of the present disclosure.

With reference to the appended drawings, the following describes an embodiment of the present disclosure. FIG. 1 is a sectional view showing an internal structure of an image forming apparatus 100 including developing devices 3*a* to 3*d* of the present disclosure. In a main body of the image forming apparatus 100 (herein, a color printer), four image forming portions Pa, Pb, Pc, and Pd are disposed in order from an upstream side in a conveyance direction (a left side in FIG. 1). The image forming portions Pa to Pd are provided correspondingly to images of four different colors (yellow, cyan, magenta, and black), respectively, and sequentially form images of yellow, cyan, magenta, and black, respectively, by individually performing steps of charging, exposure, development, and transfer.

In the image forming portions Pa to Pd, photosensitive drums (image carrying members) 1*a*, 1*b*, 1*c*, and 1 are disposed, respectively, to carry visible images (toner images) of the respective colors. Moreover, an intermediate transfer belt (an intermediate transfer member) 8 that is driven by a belt drive motor (not shown) to rotate in a counterclockwise direction in FIG. 1 is provided adjacently to the image forming portions Pa to Pd. Toner images formed respectively on the photosensitive drums 1*a* to 1*d* are sequentially and primarily transferred in a superimposed manner on the intermediate transfer belt 8 moving while abutting on the photosensitive drums 1*a* to 1*d*. After that, the toner images thus primarily transferred on the intermediate transfer belt 8 are secondarily transferred by a secondary transfer roller 9 on a transfer sheet P as an example of a recording medium. Moreover, the toner images secondarily transferred to the transfer sheet P are fixed thereon in a fixing portion 13, and then the transfer sheet P is discharged from the main body of the image forming apparatus 100. An image forming process with respect to the photosensitive drums 1*a* to 1*d* is executed while the photosensitive drums 1*a* to 1*d* are rotated in a clockwise direction in FIG. 1.

The transfer sheet P on which toner images are to be secondarily transferred is housed in a sheet cassette 16 arranged in a lower part of the main body of the image forming apparatus 100. The transfer sheet P is conveyed to a nip between the secondary transfer roller 9 and a driving roller 11 of the intermediate transfer belt 8 via a paper feed roller 12*a* and a registration roller pair 12*b*. As the intermediate transfer belt 8, a seam-free (seamless) belt formed of a dielectric resin sheet is mainly used. Furthermore, a blade-shaped belt cleaner 19 for removing a residual toner or the like remaining on a surface of the intermediate transfer belt 8 is arranged on a downstream side of the secondary transfer roller 9.

Next, a description is given of the image forming portions Pa to Pd. Charging devices 2*a*, 2*b*, 2*c*, and 2*d* that charge the photosensitive drums 1*a* to 1*d*, respectively, an exposure device 5 that performs exposure based on image information with respect to the photosensitive drums 1*a* to 1*d*, developing devices 3*a*, 3*b*, 3*c*, and 3*d* that form toner images on the photosensitive drums 1*a* to 1*d*, respectively, and cleaning devices 7*a*, 7*b*, 7*c*, and 7*d* that remove a residual developer (toner) or the like remaining on the photosensitive drums 1*a* to 1*d*, respectively, are provided around and below the photosensitive drums 1*a* to 1*d* rotatable disposed.

Upon image data being inputted from a host apparatus such as a personal computer, first, surfaces of the photosensitive drums 1*a* to 1*d* are uniformly charged by the charging devices 2*a* to 2*d*, respectively. Then, by the exposure device 5, light is applied thereto so as to correspond to image data so that electrostatic latent images corresponding to the image data are formed on the photosensitive drums 1*a* to 1*d*, respectively. The developing devices 3*a* to 3*d* are filled with prescribed amounts of two-component developers including toners of yellow, cyan, magenta, and black, respectively. In a case where a percentage of the toners in the two-component developers filled in the developing devices 3*a* to 3*d* falls below a preset value due to after-mentioned toner image formation, the developing devices 3*a* to 3*d* are replenished with fresh supplies of toners from toner containers 4*a* to 4*d*, respectively. The toners in the developers are supplied onto the photosensitive drums 1*a* to 1*d* by the developing devices 3*a* to 3*d*, respectively, and electrostatically adheres thereto. Thus, there are formed toner images corresponding to the electrostatic latent images formed by exposure from the exposure device 5.

Further, by primary transfer rollers 6*a* to 6*d*, an electric field is applied at a prescribed transfer voltage between themselves and the photosensitive drums 1*a* to 1*d*, respectively. Thus, the toner images of yellow, magenta, cyan, and black on the photosensitive drums 1*a* to 1*d* are primarily transferred on the intermediate transfer belt 8. These images are formed in a prescribed positional relationship. After that, a residual toner or the like remaining on the surfaces of the photosensitive drums 1*a* to 1*d* after primary transfer is removed by the cleaning devices 7*a* to 7*d*, respectively, in preparation for subsequent formation of new electrostatic latent images.

The intermediate transfer belt 8 is stretched over a driven roller 10 on an upstream side and the driving roller 11 on a downstream side. As the driving roller 11 is driven to rotate by the belt drive motor (not shown), the intermediate transfer belt 8 starts to rotate in the counterclockwise direction, and then the transfer sheet P is conveyed at prescribed timing from the registration roller pair 12*b* to the nip (a secondary transfer nip) between the driving roller 11 and the secondary transfer roller 9 provided adjacently thereto, where the toner images on the intermediate transfer belt 8 are secondarily transferred on the transfer sheet P. The transfer sheet P on which the toner images have been secondarily transferred is conveyed to the fixing portion 13.

The transfer sheet P conveyed to the fixing portion 13 is heated and pressed by a fixing roller pair 13*a*, and thus the toner images are fixed on a surface of the transfer sheet P to form a prescribed full-color image thereon. A conveyance direction of the transfer sheet P on which the full-color image has been formed is controlled by a branch portion 14 branching off in a plurality of directions, and the transfer sheet P is directly (or after being conveyed to a double-sided conveyance path 18 and subjected to double-sided image formation therein) discharged to a discharge tray 17 by a discharge roller pair 15.

Figure 2:
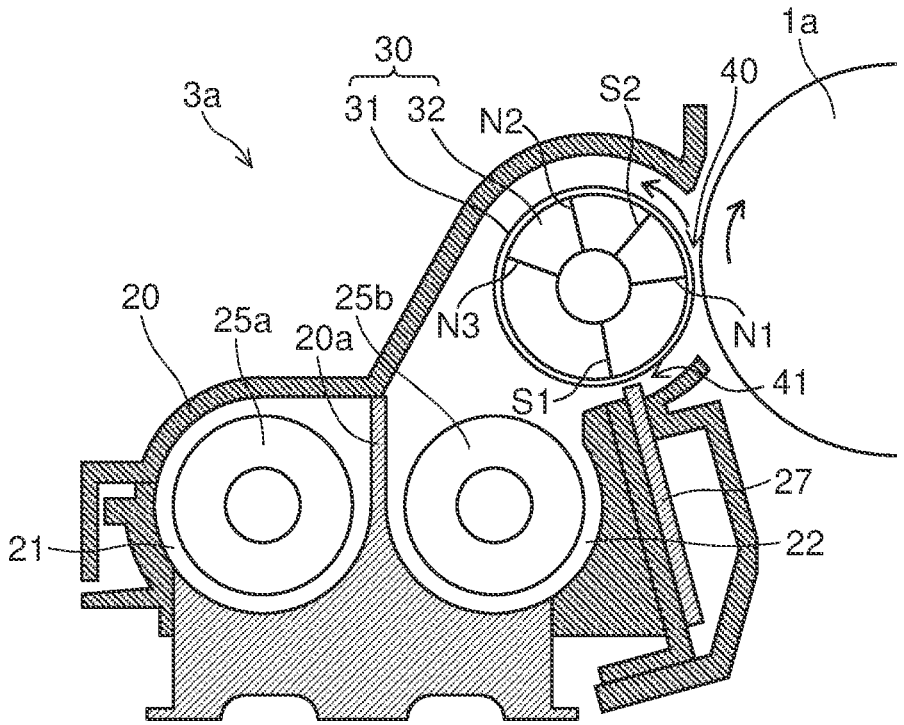
FIG. 2 is a side sectional view of a developing device according to one embodiment of the present disclosure.

FIG. 2 is a side sectional view of the developing device 3*a* mounted in the image forming apparatus 100. While the following exemplarily describes the developing device 3*a* arranged in the image forming portion Pa shown in FIG. 1, the developing devices 3*b* to 3*d* arranged in the image forming portions Pb to Pd, respectively, basically have a similar configuration to that of the developing device 3*a*, and thus descriptions thereof are omitted.

As shown in FIG. 2, the developing device 3*a* includes the developing container 20 for containing a two-component developer (hereinafter, simply referred to also as a developer) including a magnetic carrier and a toner. The developing container 20 is divided by a partition wall 20*a* into a stirring conveyance chamber 21 and a supply conveyance chamber 22. In the stirring conveyance chamber 21 and the supply conveyance chamber 22, a stirring conveyance screw 25*a* and a supply conveyance screw 25*b* for making a mixture of a toner supplied from the toner container 4*a* (see FIG. 1) and a magnetic carrier, stirring the mixture, and charging the toner are rotatably disposed, respectively. This embodiment uses a two-component developer composed of a positively chargeable toner and a ferrite/resin-coated carrier. Detailed configurations of the toner and the carrier will be described later.

Figure 3:
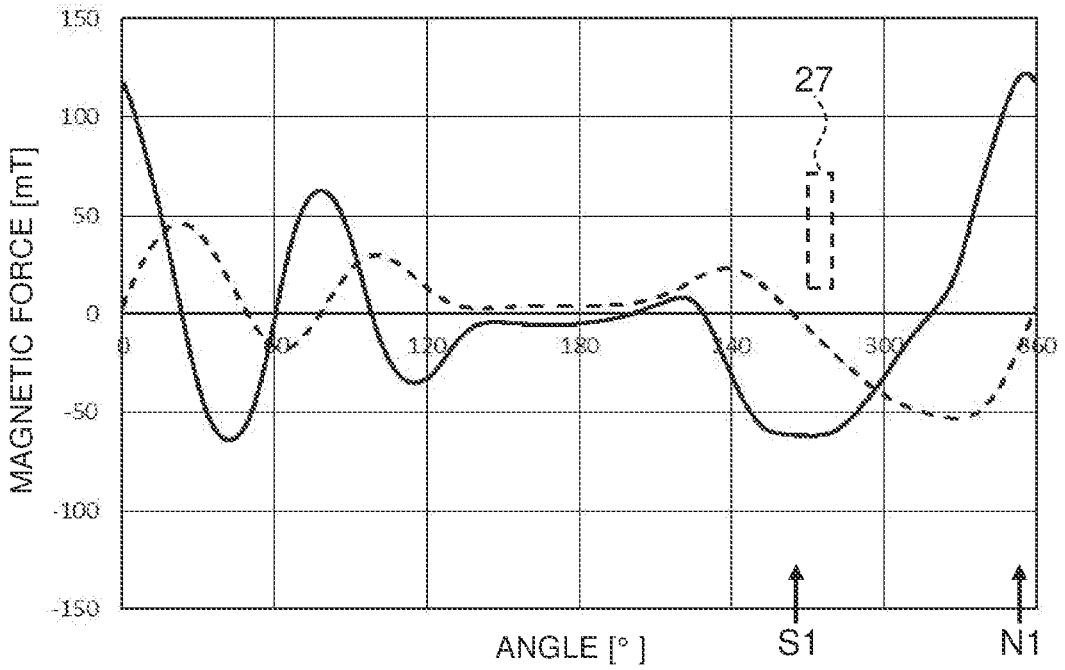
FIG. 3 is a graph showing a vertical magnetic force distribution and a horizontal magnetic force distribution in the circumferential direction of a developing roller.

Further, the developer is conveyed while being stirred by the stirring conveyance screw 25*a* and the supply conveyance screw 25*b* in an axis direction thereof (a direction perpendicular to a plane on which FIG. 3 is drawn) and circulates between the stirring conveyance chamber 21 and the supply conveyance chamber 22 via communication portions (not shown) formed at the both ends of the partition wall 20*a*. That is, in the developing container 20, a circulation route of the developer is formed by the stirring conveyance chamber 21, the supply conveyance chamber 22, and the second communication portions.

The developing container 20 extends to a diagonally upper right side in FIG. 2, and a developing roller 30 (a developer carrying member) is arranged on a diagonally upper right side of the supply conveyance screw 25*b* in the developing container 20. Further, a part of an outer circumferential surface of the developing roller 30 is exposed through an opening 20*e* of the developing container 20 and is opposed at a prescribed distance (a development gap) to the photosensitive drum 1*a*, thus forming a development region 40. The developing roller 30 rotates (performs trail rotation at a position opposed to the photosensitive drum 1*a*) in a counterclockwise direction in FIG. 3.

The developing roller 30 is composed of a cylindrical developing sleeve 31 that rotates in the counterclockwise direction in FIG. 2 and a magnet 32 that has a plurality of magnetic poles and is unrotatably secured in the developing sleeve 31. While the developing sleeve 31 used in this embodiment is a developing sleeve having a knurled surface, it is also possible to use a developing sleeve having a surface with a multitude of concaves (dimples) formed therein, a developing sleeve having a blasted surface, a developing sleeve having a surface not only knurled and including concaves formed therein but also blasted, a developing sleeve having a plated surface intended to improve endurance, a developing sleeve having an anodized surface, or a developing sleeve having a surface treated, after being anodized, by a method in which a metallic salt such as Ni, Sn, or Mo is applied to a porous region of anodized aluminum. i.e., a so-called secondary electrolytic coloring method. Particularly when having an anodized surface or a surface treated, after being anodized, by the secondary electrolytic coloring method, a developing sleeve has not only improved endurance but also an effect of suppressing the occurrence of a development leak. This is because, with the surface of the developing sleeve anodized, a leakage current generated at a magnetic brush becomes unlikely to spread in a circumferential direction on a surface of the developing roller 30 and thus is prevented from developing into a larger-scale leakage current involving adjacent magnetic brushes.

The magnet 32 has a five-pole configuration composed of a main pole N1, a regulation pole (pumping pole) S1, conveyance poles S2 and N2, and a peeling pole N3. Upon a drive force being inputted to the developing device 3*a*, while the developing sleeve 31 rotates, the magnet 32 does not rotate. By a developing voltage power supply (not shown), a developing voltage composed of a direct current voltage Vdc and an alternating current voltage Vac is applied to the developing roller 30.

Furthermore, a regulation blade 27 (a regulation member) is attached to the developing container 20 along a longitudinal direction of the developing roller 30 (a perpendicular direction to the plane on which FIG. 2 is drawn). A slight clearance (gap) is formed between a distal end of the regulation blade 27 and a surface of the developing roller 30, thus forming a regulation portion 41. In this embodiment, a magnetic blade made of stainless steel (SUS430) is used as the regulation blade 27.

A magnetic field in a direction of magnetic attraction between the regulation pole S1 of the magnet 32 and the regulation blade 27 is generated, so that a magnetic brush is formed by developer particles linked into chains between the regulation blade 27 and the developing roller 30, and when the magnetic brush passes through the regulation blade 27 (the regulation portion 41), a layer thereof is regulated to a desired height. After that, when the developing sleeve 31 rotates in the counterclockwise direction and the magnetic brush moves to the development region 40, the main pole N1 applies a magnetic field, and thus the magnetic brush makes contact with the surface of the photosensitive drum 1*a* and develops an electrostatic latent image thereon.

When the developing sleeve 31 rotates further in the counterclockwise direction, the conveyance poles S2 and N2 apply a magnetic field in a direction along the outer circumferential surface of the developing sleeve 31 to the magnetic brush, and thus together with the magnetic brush, a part of the developer left unused for toner image formation is collected on the developing sleeve 31. Moreover, at the peeling pole N3 being identical in polarity to the conveyance pole N2, the magnetic brush is separated from the developing roller 30 and falls into the supply conveyance chamber 22. Further, the magnetic brush that has thus fallen is stirred and conveyed by the supply conveyance screw 25*b*, and then a magnetic field of the regulation pole S1 again causes a magnetic brush to be formed on the developing sleeve 31.

Figure 4:
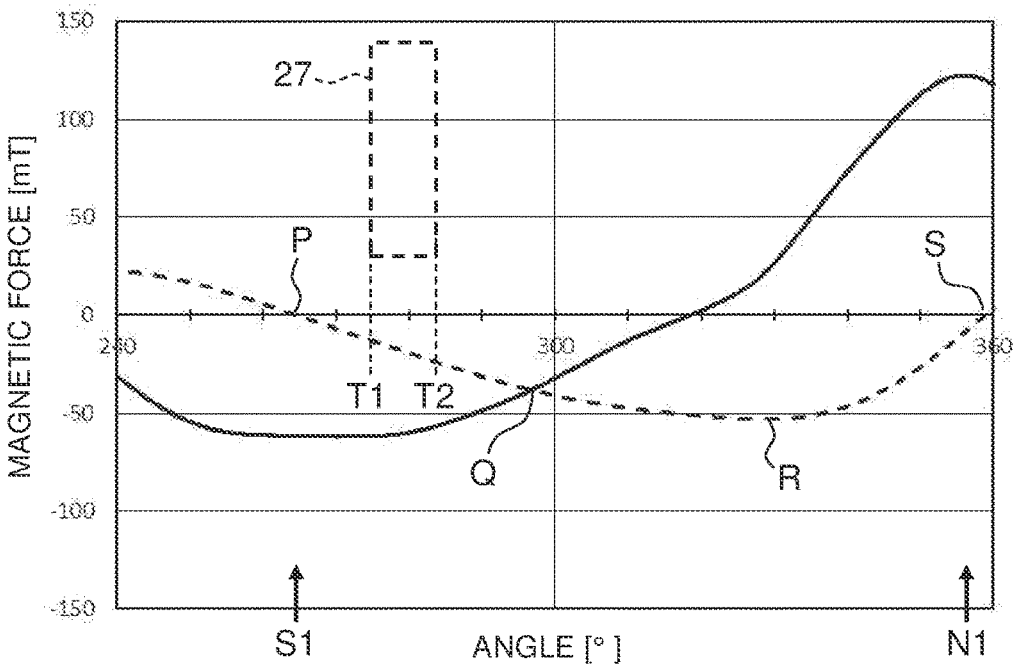
FIG. 4 is an enlarged view from the regulation blade to a main pole in FIG. 3.
Figure 5:
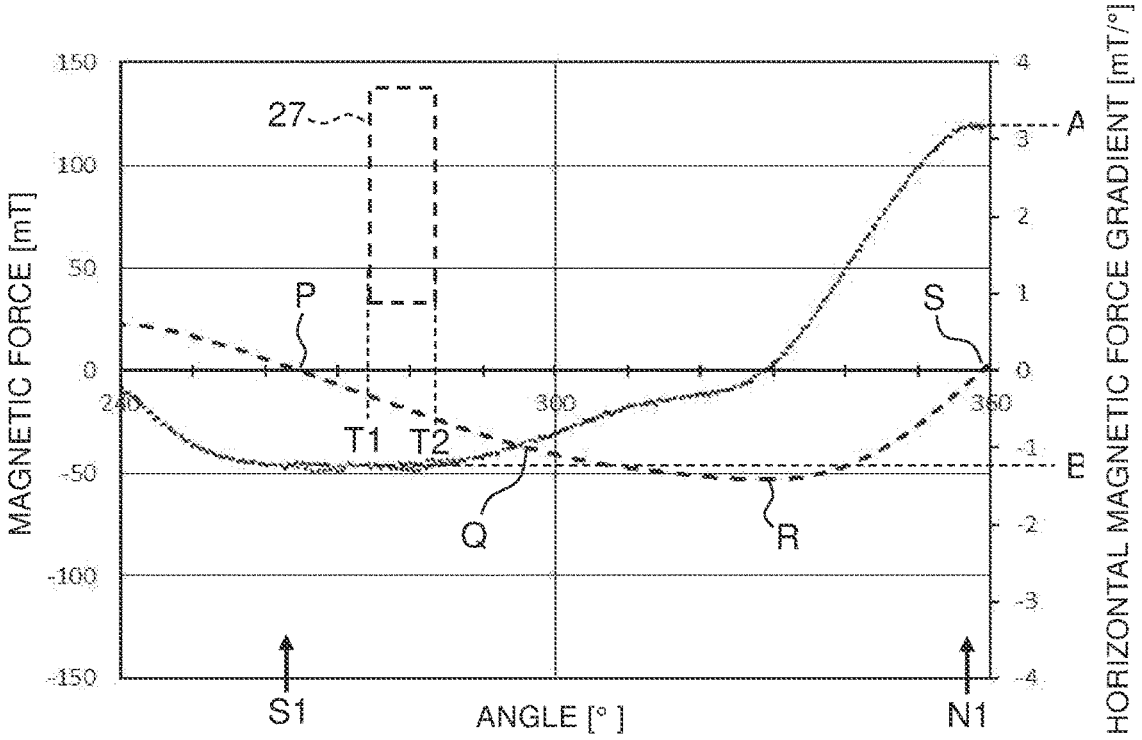
FIG. 5 is a graph showing the horizontal magnetic force distribution and variation in the horizontal magnetic force gradient in FIG. 4.

Next, a description is given of a magnetic force distribution of the magnet 32 in the circumferential direction of the developing roller 30, which characterizes the present disclosure. FIG. 3 is a graph showing a vertical magnetic force distribution and a horizontal magnetic force distribution in the circumferential direction of the developing roller 30. FIG. 4 is an enlarged view from the regulation blade 27 to the main pole Ni in FIG. 3. FIG. 5 is a graph showing the horizontal magnetic force distribution and variation in the horizontal magnetic force gradient in FIG. 4. With reference to FIGS. 3 to 5, the horizontal magnetic force gradient of the magnet 32 in the developing devices 3*a* to 3*d* according to the embodiment will be described in detail. In FIGS. 3 to 5, a vertical magnetic force is shown by a solid line, a horizontal magnetic force is shown by a broken line, and a vertical magnetic force gradient is shown by a dotted line.

In the developing devices 3*a* to 3*d* according to the embodiment, through adjustment of the magnetic force distribution of the magnet 32 in the circumferential direction of the developing roller 30, more specifically, through the adjustment of the magnetic force gradient (hereinafter referred to as the horizontal magnetic force gradient) in the circumferential direction of the horizontal magnetic force, which is the magnetic force of the developing roller 30 in the circumferential direction, the developer scrape-off effect by the magnetic brush is improved to suppress carrier development.

As shown in FIGS. 3 and 4, near the peak (point S in FIGS. 4 and 5) of the vertical magnetic force of the main pole Ni, the horizontal magnetic force is 0 [mT]. The horizontal magnetic force gradient around there is considered to be related to the scraping of developer off the surfaces of the photosensitive drums 1*a* to 1*d*. This scrape-off effect by the magnetic brush on the surfaces of the photosensitive drums 1*a* to 1*d* is affected by the amount of developer that is conveyed into the development region 40 (i.e., the conveyed developer amount). Accordingly, the more likely the conveyed developer amount is to vary, the more likely the scrape-off effect is to vary, and this makes it impossible to obtain a stable scrape-off effect.

The variation of the conveyed developer amount is affected by the horizontal magnetic force gradient at the position at which the developing roller 30 and the regulation blade 27 face each other (i.e., the regulation portion 41). Specifically, a small horizontal magnetic force gradient in the regulation portion 41 results in a small variation in the vertical magnetic force, and this helps reduce the effect of the magnetic force on variation of the flowability of developer attributable to variation of the toner concentration in the developer and the amount of electric charge of the toner.

That is, by giving a large horizontal magnetic force gradient at the position of the main pole N1 (the development region 40) and thereby improving the scrape-off effect, and giving a small horizontal magnetic force gradient at the position of the regulation pole S1 (the regulation portion 41) and thereby improving robustness (stability against noise), it is possible to stably suppress carrier development. More specifically, when the horizontal magnetic force gradient at the position (point S in FIG. 5) at which the horizontal magnetic force of the main pole N1 is 0 [mT] is represented by A [mT/°] and the horizontal magnetic force gradient at the upstream-side surface (T1 in FIG. 5) of the regulation blade 27 is represented by B [mT/°], then $|A|>2.45$ and $|B|<1.30$ are fulfilled.

Next, the arrangement of the regulation blade 27 will be described. Between the position (point P in FIGS. 4 and 5) at which the horizontal magnetic force of the regulation pole S1 is 0 [mT] and the position (point R in FIGS. 4 and 5) at which the horizontal magnetic force has a local maximum value, the horizontal magnetic force acts in the direction pointing from R to P. Accordingly, if the regulation blade 27 is located on the downstream side of point P, the developer in the regulation portion 41 is acted on by a force that moves it back in the direction of P, and this mitigates the developer conveying force that results from (Vertical Magnetic Force× Friction Coefficient Between Developer and Developing Sleeve 31). It is thus possible to perform regulation highly robust against variation of the flowability of developer and the like.

In contrast, if the downstream-side surface (T2 in FIG. 5) of the regulation blade 27 is located on the downstream side of the position (Q in FIG. 4) at which the horizontal magnetic force and the vertical magnetic force are equal, the vertical magnetic force in the regulation portion 41 is so weak that it is impossible to secure a sufficient magnetic regulation force. This makes stable conveyance of developer impossible. Thus, with respect to the rotation direction of the developing sleeve 31, the upstream-side surface (T1 in FIG. 5) of the regulation blade 27 needs to be arranged on the downstream side of the position (point P in FIG. 5) at which the horizontal magnetic force of the regulation pole S1 is 0 [mT], and the downstream-side surface (T2 in FIG. 5) of the regulation blade 27 needs to be arranged on the upstream side of the position (point Q in FIG. 5) at which the vertical magnetic force and the horizontal magnetic force are equal.

By defining the horizontal magnetic force gradient and the arrangement of the regulation blade 27 as described above, it is possible, while effectively suppressing carrier development, to secure a magnetic regulation force in the regulation portion 41 and convey developer stably.

Next, a description is given of a method for measuring the horizontal magnetic force gradient of the magnet 32 of the developing roller 30. In this embodiment, the developing roller 30 is attached to an angle adjusting jib, and while the developing roller 30 is rotated for a set angle at a time, the measurement was performed using a magnetic force measuring device (GAUSS METER Model GX-100 produced by Nihon Denji Sokki Co., Ltd.). While when measurement accuracy is extremely high, the horizontal magnetic force gradient can be determined by dividing a difference between values of the horizontal magnetic force measured at different angles by a difference in measurement angle, when the measurement accuracy is low, the horizontal magnetic force gradient cannot be determined with accuracy. For this reason, in the present disclosure, the horizontal magnetic force was measured at a measurement angle varied by 0.02°, and (a difference in horizontal magnetic force at a difference of 0.08°/0.08°) was defined to be a gradient 1 at a middle point within a range of 0.08°. Further, an average gradient per 2° of the gradient 1 was used as the horizontal magnetic force gradient. Table 1 shows an example of the measurement of the horizontal magnetic force gradient.

TABLE 1

| Angle | Horizontal Magnetic | Gradient 1 | | Average Gradient | |
|---|---|---|---|---|---|
| [°] | Force [mT] | [mT/°] | Calculation Method | [mT/°] | Calculation Method |
| 10.00 | 23.9 | 2.50 | Horizontal Magnetic Force Difference Between Values at 9.96° and 10.04°)/0.08 | 2.59 | Average of Values of Gradient 1 at 9.00° to 11.00° |
| 10.02 | 24.0 | 2.50 | Horizontal Magnetic Force Difference Between Values at 9.98° and 10.06°)/0.08 | 2.57 | Average of Values of Gradient 1 at 9.02° to 11.02° |
| 10.04 | 24.0 | 2.50 | Horizontal Magnetic Force Difference Between Values at 10.00° and 10.08°)/0.08 | 2.57 | Average of Values of Gradient 1 at 9.04° to 11.04° |
| 10.06 | 24.1 | 2.50 | Horizontal Magnetic Force Difference Between Values at 10.02° and 10.10°)/0.08 | 2.57 | Average of Values of Gradient 1 at 9.06° to 11.06° |
| 10.08 | 24.1 | 3.75 | Horizontal Magnetic Force Difference Between Values at 10.04° and 10.12°)/0.08 | 2.57 | Average of Values of Gradient 1 at 9.08° to 11.08° |
| 10.10 | 24.2 | 2.50 | Horizontal Magnetic Force Difference Between Values at 10.06° and 10.14°)/0.08 | 2.57 | Average of Values of Gradient 1 at 9.10° to 11.10° |
| 10.12 | 24.3 | 3.75 | Horizontal Magnetic Force Difference Between Values at 10.08° and 10.16°)/0.08 | 2.57 | Average of Values of Gradient 1 at 9.12° to 11.12° |
| 10.14 | 24.3 | 2.50 | Horizontal Magnetic Force Difference Between Values at 10.10° and 10.18°)/0.08 | 2.56 | Average of Values of Gradient 1 at 9.14° to 11.14° |
| 10.16 | 24.4 | 2.50 | Horizontal Magnetic Force Difference Between Values at 10.12° and 10.20°)/0.08 | 2.56 | Average of Values of Gradient 1 at 9.16° to 11.16° |

In Table 1, for example, the gradient 1 (2.50 [mT/°]) at an angle of 10.00° has a value obtained by dividing by 0.08° a difference G1-G2 between a horizontal magnetic force G1 at 9.96° and a vertical magnetic force G2 at 10.04°. Furthermore, the average gradient (2.59 [mT/°]) at 10.00° is an average value of values of the gradient 1 (2°/0.02°=100 values) per 2° between 9.00° and 11.00°.

Next, a description is given of a carrier used in the developing devices 3*a* to 3*d* of this embodiment. The carrier used herein includes a carrier core that is a particle of a magnetic substance and the coat layer that is made of a silicone resin or the like and is formed on a surface of the carrier core. A silicone-based resin can be applied to form a thin coat film, thus enhancing uniformity of the coat layer. Furthermore, the smaller a thickness of the coat layer, the higher a capacitance of the coat layer, and thus an effect of the ferroelectric substance added to the coat layer becomes likely to be exerted.

The carrier can be of a varying shape from indefinite to spherical. Moreover, as the carrier, a carrier having an average particle diameter (number-average particle diameter) of not less than 20 μm and not more than 65 μm can be used. When having an average particle diameter of not more than 65 μm, the carrier is increased in specific surface area and thus can carry an increased amount of the toner. Thus, a toner concentration in a magnetic brush can be maintained high, and the toner is therefore sufficiently supplied to the developing roller 30, so that a toner layer having a sufficient thickness can be formed. As a result, it is possible to cause a sufficient amount of the toner to fly from the toner layer to an electrostatic latent image on a photosensitive member, to suppress a decrease in image density, and to suppress unevenness in the image density. Furthermore, since the toner is sufficiently supplied to the developing roller 30, it becomes unlikely that a toner dropout region is formed in the toner layer of the developing roller 30, thus suppressing the occurrence of a hysteresis.

When the carrier has an average particle diameter smaller than 20 μm, there occurs carrier development in which the carrier adheres to the photosensitive drums 1*a* to 1*d*. The carrier that has adhered thereto might shift to the intermediate transfer belt 8 to cause a transfer void or move to the belt cleaner 19 to cause a cleaning failure. Furthermore, when the carrier has an average particle diameter larger than 65 μm, with the toner in the two-component developer moving from the developing roller 30 to any of the photosensitive drums 1*a* to 1*d*, a coarse magnetic brush of the two-component developer is formed to degrade image quality.

Examples of a material of the carrier core include magnetic metals such as iron, nickel, and cobalt, alloys thereof, alloys containing rare earths, soft ferrites such as hematite, magnetite, manganese-zinc-based ferrite, nickel-zinc-based ferrite, manganese-magnesium-based ferrite, and lithium-based ferrite, iron-based oxides such as copper-zinc-based ferrite, and mixtures thereof. The carrier core is produced by a known method such as sintering or atomization. Among carriers made of the above-described materials, ferrite carriers have excellent fluidity and are also chemically stable and thus are favorably used from viewpoints of enhancing image quality and prolonging service life.

As the ferroelectric substance, barium titanate particles are added to the coat layer. While hydrothermal polymerization, an oxalate method, or the like is used to produce barium titanate, barium titanate has physical properties varying depending on a production method thereof. When produced by the hydrothermal polymerization in particular, barium titanate has hollows therein and thus has a small absolute specific gravity and a sharp particle diameter distribution. As a result, compared with a case of being produced by any other production method, barium titanate produced by the hydrothermal polymerization has excellent dispersibility in a coat resin and thus can be dispersed uniformly. Accordingly, the charging performance of the carrier is also made uniform, and thus the hydrothermal polymerization is suitably used in the present disclosure.

Preferably, barium titanate has a volume average particle diameter of not less than 100 nm and not more than 500 nm. When having a particle diameter smaller than 100 nm, barium titanate is abruptly decreased in relative dielectric constant, so that an effect thereof related to the relative dielectric constant is reduced. On the other hand, when having a particle diameter of not less than 500 nm, barium titanate can hardly be uniformly dispersed in the coat layer.

When barium titanate is added in an amount of not less than 5 parts by mass with respect to a coat weight, an effect of stabilizing a charge amount starts to manifest itself, and when barium titanate is added in an amount of not less than 25 parts by mass with respect thereto, the effect of stabilizing a charge amount is more remarkably exhibited. When added in an excessively large amount, however, barium titanate can no longer be completely contained in the coat layer and might be partly liberated from the coat layer. A liberated part of the barium titanate might move to the photosensitive drums 1*a* to 1*d* and further into an edge part of a cleaning blade 32 of each of the cleaning devices 7*a* to 7*d*, resulting in causing a cleaning failure. Particularly in a method in which toners in the toner containers 4*a* to 4*d* are each mixed with a carrier and then are replenished to the developing devices 3*a* to 3*d*, respectively, a part of barium titanate liberated through use thereof is supplied to the developing devices 3*a* to 3*d* to increase a load on the cleaning blade 32. For this reason, barium titanate is added in an amount of preferably not less than 5 parts by mass and not more than 45 parts by mass and more preferably not less than 25 parts by mass and not more than 45 parts by mass.

As an electric conductor, carbon black is added to the coat layer. When the carbon black is added in an excessively large amount, a part of the carbon black liberated from the coat layer might adhere to the toner, causing color turbidity of toners of colors other than black. On the other hand, when the carbon black is added in an excessively small amount, it is unlikely that electric charge moves from the carrier to the toner, resulting in a failure to cause a smooth increase in toner charge amount. In the carrier of the present disclosure, barium titanate (the ferroelectric substance) is added to the coat layer so that a carrier resistance is decreased, and thus an amount of carbon black to be added can be reduced by an amount corresponding to a decrease in the carrier resistance.

Adding the ferroelectric substance (barium titanate) to the coat layer enhances an electric charge retaining capability of the carrier, thus enabling sufficient electric charge to be applied to the toner. Furthermore, adding the electric conductor (carbon black) to the coat layer enables smooth movement of electric charge from the carrier to the toner. Even when a toner concentration is increased to increase the number of toner particles to be charged, synergy between the above-described two additives enables electric charge to be applied to a saturation level of a charge amount of the toner particles.

Furthermore, barium titanate having a high hardness is added as the ferroelectric substance to the coat layer of the carrier, so that abrasion of the coat layer is reduced, thus making it possible to achieve a longer service life of the carrier. Furthermore, with barium titanate added, a carrier resistance is decreased compared with a case where only carbon black is added, and thus an amount of carbon black to be added can be reduced. As a result, it is possible to suppress color turbidity resulting from adhesion of carbon black to the toner. Moreover, the carrier is improved in electric charge imparting performance, and thus even when a toner concentration in the developer is increased, a change in toner charge amount is reduced. As a result, the toner charge amount is stabilized and, compared with carrier containing no barium titanate, the magnetic regulation force at the regulation blade 27 exhibits high stability. Thus, the conveyed developer amount stabilizes more easily, and this makes it possible to suppress carrier development stably.

Other than the above, the present disclosure is not limited to the foregoing embodiment and can be variously modified without departing from the spirit of the present disclosure. For example, while in the foregoing embodiment the magnet 32 of the developing roller 30 has a configuration in which the regulation pole S1 and the main pole N1 are arranged, the regulation pole and the main pole may have different polarities from each other.

Furthermore, while the foregoing embodiment exemplarily describes the color printer shown in FIG. 1 as the image forming apparatus 100, the present disclosure is not limited to a color printer and is applicable also to various types of image forming apparatuses including a developing device that employs the two-component development method, such as monochrome and color copy machines, a monochrome printer, and a digital multi-functional peripheral. The following more specifically describes the effects of the present disclosure with reference to examples.

Example 11

[Production of Carrier Containing Ferroelectric Particles]

By use of a homomixer, 200 parts by mass of a silicone resin (KR-255 produced by Shin-Etsu Chemical Co., Ltd. and having a nonvolatile content of 50%), 20 parts by mass of barium titanate (produced by Sakai Chemical Industry Co., Ltd. and having a volume average particle diameter of 304 nm), 7 parts by mass of carbon black (Ketjenblack EC produced by Lion Corporation), and 800 parts by mass of toluene were dispersed to provide a coat solution. The coat solution thus obtained was sprayed using a fluidized-bed coating device over 5 kg of a carrier core (an Mn ferrite carrier having a volume average particle diameter of 34.7 μm, a saturation magnetization of 80 emu/g, and a coercive force of 8 Oe and produced by Dowa IP Creation Co., Ltd.) under heating at 70° C. to 80° C. so that the carrier core was coated with the coat solution. After that, the carrier core was calcined for an hour at 200° C. to 250° C. using an electric furnace, was cooled down, and then was crushed and classified using a sieve to provide a carrier that included a coat layer containing ferroelectric particles.

Example 21

[Evaluation of Regulation Stability and Carrier Development When Horizontal Magnetic Force Gradient Is Varied]

An evaluation was performed of regulation stability (the stability of the magnetic regulation force at the regulation blade 27) and carrier development when the horizontal magnetic force gradient of the developing roller 30 was varied. In a test method, the developing devices 3*a* to 3*d* configured as shown in FIG. 2 (Disclosed Examples 1 to 3 and Comparative Examples 1 to 6) were mounted in a test apparatus as shown in FIG. 1. The developing devices 3*a* to 3*d* were made to vary in terms of the vertical magnetic force and the horizontal magnetic force gradient of the main pole N1 and the regulation pole S1 and the position of the regulation blade 27. Using this test apparatus, regulation stability and carrier development were evaluated while the developing devices were driven in a high-temperature, high-humidity environment (32.5° C., 80%) and in a low-temperature, low-humidity environment (10° C., 15%).

Image formation conditions were as follows. That is, a printing velocity (a process velocity) was set to 55 sheets per minute, used as the developing roller 30 was a developing sleeve 31 having an outer circumferential surface in which 80 rows of concaves were formed (knurled) and an outer diameter of 20 mm, used as the regulation blade 27 was a magnetic blade made of stainless steel (SUS430) and having a thickness of 1.5 mm, and a distance (a regulation gap) between the regulation blade 27 and the developing roller 30 was set to 0.5±0.03 mm. A development voltage obtained by superimposing an alternating-current voltage having a peak-to-peak value (Vpp) of 1125 V, a frequency of 10 kHz, and a duty of 50% on a direct-current voltage of 250 V was applied to the developing roller 30.

The photosensitive drums 1*a* to 1*d* were formed of an amorphous silicon (a-Si) photosensitive member having a relative dielectric constant of 11, the developing roller 30 was set to rotate (perform trail rotation at an opposed position) at a circumferential velocity ratio of 1.8 with respect to each of the photosensitive drums 1*a* to 1*d*, and a distance (a DS (drum-sleeve) distance) between each of the photosensitive drums 1*a* to 1*d* and the developing roller 30 was set to 0.375 f 0.025 mm. Furthermore, an elastic belt was used as the intermediate transfer belt 8.

A positively chargeable toner having an average particle diameter of 6.8 μm was used as a toner, and a resin-coated carrier produced in Example 1 was used as a carrier. An initial toner concentration in the developers (a weight ratio of the toner to each of the carriers) was set to 5% and 7%. As developer, two kinds of developer, unused and used (corresponding to after printing on 100000 sheets), were used.

An evaluation method was as follows. For regulation stability, the variation ratio of the conveyed developer amount ((Maximum Value−Average Value)/Average Value× 100) was calculated, and a case where the variation ratio was 15% or less was evaluated as "G (good)" and a case where the variation ratio was over 15% was evaluated as "P (poor)". For carrier development, the number of carrier particles that moved onto the photosensitive drums 1*a* to 1*d* was observed using a magnifying glass, and a case where the maximum number per unit area was 5 particles/cm$^2$ or less was evaluated as "E (excellent)", a case where it was 10 particles/cm$^2$ or less was evaluated as "G (good)", and a case where it was over 10 particles/cm$^2$ was evaluated as "P (poor)". The evaluation results are shown in Table 2 along with the vertical magnetic force and the horizontal magnetic force gradient of the main pole Ni and the regulation pole S1 and the position of the regulation blade.

TABLE 2

| | Vertical Magnetic Force [mT] | | Horizontal Magnetic Force Gradient [mT/°] | | Regulation Blade Position | | Regulation Stability | | Carrier Development | |
|---|---|---|---|---|---|---|---|---|---|---|
| | Main Pole | Regulation Pole | Main Pole | Regulation Pole | Upstream Side Surface | Downstream Side Surface | Variation Ratio [%] | Evaluation | Particles/cm$^2$ | Evaluation |
| Disclosed Example 1 | 122 | 62 | 3.10 | 1.24 | P~Q | P~Q | 14 | G | 4 | E |
| Disclosed Example | 104 | 52 | 2.50 | 1.21 | P~Q | P~Q | 13 | G | 9 | G |
| Disclosed Example 3 | 100 | 51 | 2.70 | 1.06 | P~Q | P~Q | 11 | G | 6 | G |
| Comparative Example 1 | 107 | 77 | 2.62 | 1.58 | P~Q | P~Q | 25 | P | 16 | P |
| Comparative Example 2 | 100 | 72 | 2.44 | 1.30 | P~Q | P~Q | 16 | P | 14 | P |

TABLE 2-continued

| | Vertical Magnetic Force [mT] | | Horizontal Magnetic Force Gradient [mT/°] | | Regulation Blade Position | | Regulation Stability | | Carrier Development | |
|---|---|---|---|---|---|---|---|---|---|---|
| | | | | | Upstream | Downstream | Variation | | | |
| | Main Pole | Regulation Pole | Main Pole | Regulation Pole | Side Surface | Side Surface | Ratio [%] | Evaluation | Particles/ $cm^2$ | Evaluation |
| Comparative Example 3 | 93 | 44 | 2.37 | 0.91 | P~Q | P~Q | 10 | G | 13 | P |
| Comparative Example 4 | 96 | 60 | 2.18 | 1.17 | P~Q | P~Q | 13 | G | 22 | P |
| Comparative Example 5 | 105 | 33 | 2.45 | 0.62 | P~Q | P~Q | 9 | G | 12 | P |
| Comparative Example 6 | 131 | 55 | 3.07 | 1.16 | Q~R | Q~R | 18 | P | 13 | P |

Table 2 confirms the following. In the developing devices 3*a* to 3*d* of Disclosed Examples 1 to 3 where the horizontal magnetic force gradient A at the main pole Ni and the horizontal magnetic force gradient B at the regulation pole S1 fulfilled |A|>2.45 and |B|<1.30 and in addition the regulation blade 27 was arranged between points P and Q, the variation ratio of the conveyed developer amount was 15% or less and the number of particles of carrier development was 10 particles/$cm^2$ or less, attesting improved regulation stability and suppressed carrier development.

By contrast, in Comparative Examples 1 and 2 where the horizontal magnetic force gradient B at the regulation pole S1 was |B|>1.30, because of a large horizontal magnetic force gradient near the regulation blade 27, the conveyed developer amount was over 15%. Thus, regulation stability was not secured, resulting in aggravated carrier development.

On the other hand, in Comparative Examples 3 to 5 where the horizontal magnetic force gradient A at the main pole N1 was |A|≤2.45, while the variation ratio of the conveyed developer amount was 15% or less, attesting superb regulation stability, because of a small horizontal magnetic force gradient at the main pole N1, the magnetic brush exhibited poor scraping-off performance, resulting in aggravated carrier development. In Comparative Example 6 where the regulation blade 27 was arranged between points Q and R, the vertical magnetic force near the regulation blade 27 was so weak that a sufficient magnetic regulation force was not secured, resulting in aggravated carrier development.

The results above confirm the following. By arranging the regulation blade 27 between points P and Q and adopting a horizontal magnetic force distribution such that the horizontal magnetic force gradient A at the main pole N1 and the horizontal magnetic force gradient B at the regulation pole Si fulfill |A|>2.45 and |B|<1.30, it is possible to secure regulation stability and to effectively suppress carrier development.

While the results described were obtained by using the resin-coated carrier containing barium titanate added thereto as ferroelectric particles, which was produced in Example 1, it has been confirmed that similar effects can be obtained also by using other types of carriers.

The present disclosure is usable in a developing device that uses a two-component developer including a toner and a carrier. Through the use of the present disclosure, it is possible to provide a developing device capable of suppressing carrier development while maintaining the stability of the magnetic regulation force of a regulation member in the two-component development method, and an image forming apparatus including the same.

What is claimed is:

1. A developing device, comprising:

a developing container that stores a two-component developer containing a magnetic carrier and a toner;

a developer carrying member that is rotatably supported on the developing container and carries the developer on an outer circumferential surface thereof; and a regulation member that is arranged to be opposed at a prescribed distance to the developer carrying member, the developing device developing an electrostatic latent image formed on a surface of an image carrying member into a toner image, wherein the developer carrying member includes:

a developing sleeve that is rotatable, carries the developer, and has a surface on which a magnetic brush is formed; and a magnet that is unrotatably secured in the developing sleeve and has a plurality of magnetic poles arranged at a prescribed distance from each other in a circumferential direction, which include a regulation pole that is arranged in a regulation portion opposed to the regulation member and a main pole that is arranged in a development region opposed to the image carrying member on a downstream side of the regulation pole with respect to a rotation direction of the developing sleeve, the regulation member is arranged, with respect to the rotation direction of the developing sleeve, on a downstream side of a position at which a vertical magnetic force of the regulation pole is 0 [mT] but on an upstream side of a position at which the vertical magnetic force and a horizontal magnetic force of the regulation pole are equal, and when a horizontal magnetic force gradient at the a position at which a horizontal magnetic force of the main pole is 0 [mT] is represented by A [mT/°] and the horizontal magnetic force gradient at an upstream-side surface of the regulation member with respect to the rotation direction of the developing sleeve is represented by B [mT/°], then |A|>2.45 and |B|<1.30 are fulfilled.

2. The developing device according to claim 1, wherein the carrier has a coat layer of a resin formed on a surface of a carrier core that is a particle of a magnetic substance, the coat layer containing carbon black as an electric conductor and a barium titanate as a ferroelectric substance, the barium titanate has a volume average particle diameter of not less than 100 nm and not more than 500 nm, and the barium titanate is added in an amount of 5 to 45 parts by mass with respect to 100 parts by mass of a coat resin forming the coat layer.

3. The developing device according to claim 2, wherein the barium titanate is added in an amount of 25 to 45 parts by mass with respect to 100 pars by mass of the coat resin.

4. An image forming apparatus, comprising:

an image carrying member that has a photosensitive layer formed on a surface thereof; and the developing device according to claim 1 that makes the toner adhere to the electrostatic latent image formed on the image carrying member so as to form a toner image.

* * * * *